United States Patent [19]

Pross et al.

[11] Patent Number: 4,719,775

[45] Date of Patent: Jan. 19, 1988

[54] CENTRAL LOCKING SYSTEM FOR AUTOMOTIVE VEHICLES

[75] Inventors: Fritz Pross, Wildberg; Rudi Kneib, Sindelfingen; Guenther Weikert, Weil der Stadt; Klaus J. Heimbrodt, Treuchtlingen, all of Fed. Rep. of Germany

[73] Assignee: Daimler-Benz Aktiengesellschaft, Stuttgart, Fed. Rep. of Germany

[21] Appl. No.: 880,209

[22] Filed: Jun. 30, 1986

[30] Foreign Application Priority Data

Jun. 29, 1985 [DE] Fed. Rep. of Germany ..... 3523432

[51] Int. Cl.[4] ..... E05B 53/00

[52] U.S. Cl. ..... 70/264; 70/254; 70/262

[58] Field of Search ..... 70/237–239, 70/254, 262–264

[56] References Cited

U.S. PATENT DOCUMENTS

| | | | |
|---|---|---|---|
| 2,506,851 | 5/1950 | Ayers | 70/264 |
| 2,530,628 | 11/1950 | Pivero | 70/264 X |
| 2,659,230 | 11/1953 | Craig | 70/264 |
| 2,694,920 | 11/1954 | Courtney | 70/264 |
| 2,888,287 | 5/1959 | Taylor | 70/263 X |
| 3,064,752 | 11/1962 | Deibel et al. | 70/262 X |
| 3,070,184 | 12/1962 | Riester | 70/263 X |
| 3,111,184 | 11/1963 | Oishei | 70/264 X |
| 3,357,215 | 12/1967 | Riester et al. | 70/264 |
| 3,520,159 | 7/1970 | Swanney | 70/264 X |
| 3,531,957 | 10/1970 | Gowans | 70/264 |
| 3,630,305 | 12/1971 | Kazaoka | 70/264 X |
| 3,633,391 | 1/1972 | Andres | 70/264 |
| 3,722,615 | 3/1973 | Okada et al. | 70/264 X |
| 4,253,319 | 3/1981 | Feichtiger et al. | 70/264 |

FOREIGN PATENT DOCUMENTS

| | | | |
|---|---|---|---|
| 2818703 | 11/1978 | Fed. Rep. of Germany | 70/239 |
| 3002986 | 8/1981 | Fed. Rep. of Germany | 70/263 |
| 3312091 | 10/1984 | Fed. Rep. of Germany | 70/264 |
| 2457366 | 1/1981 | France | 70/264 |

*Primary Examiner*—Robert L. Wolfe
*Assistant Examiner*—Suzanne L. Dino
*Attorney, Agent, or Firm*—Barnes & Thornburg

[57] ABSTRACT

A central locking system for motor vehicles is provided in which, in addition to the key-actuated central function for the locking or unlocking of door locks, an automatic central locking takes place when the vehicle engine is started and on. However, the automatic central locking of the vehicle can be overridden when the engine is running so that entry and exit are possible. After the entry or exit while the engine is running, the doors of the vehicle are again automatically centrally locked.

2 Claims, 1 Drawing Figure

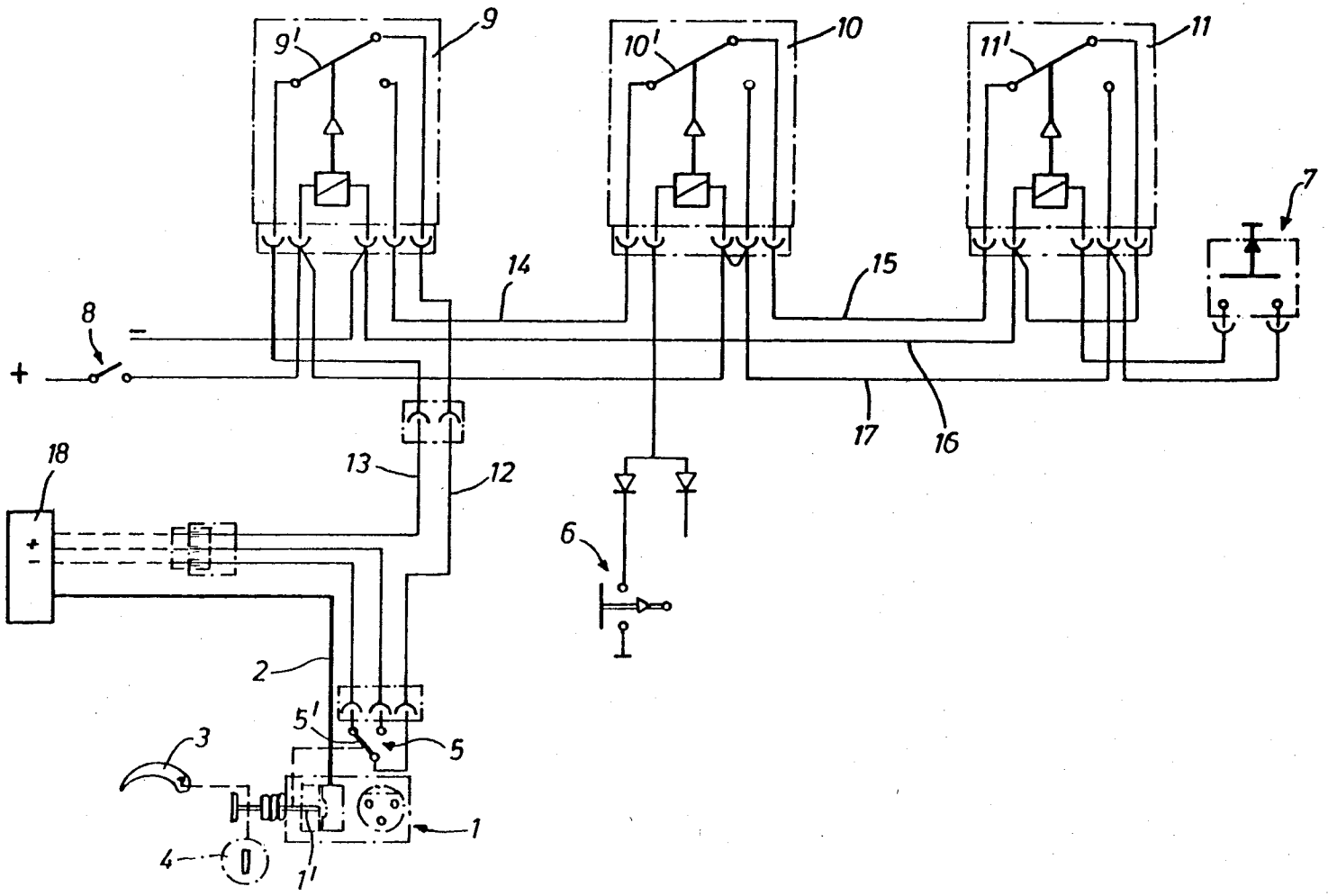
7
11
11'
16
15
17
10
10'
6
14
12
9
9'
13
5
5'
1
1'
2
3
4
8
18
+
-

CENTRAL LOCKING SYSTEM FOR AUTOMOTIVE VEHICLES

BACKGROUND AND SUMMARY OF THE INVENTION

The present invention relates to a central locking system for a motor vehicle having a means for locking and unlocking a door lock at each of a plurality of doors. A driving operation indicator indicates when the vehicle is being driven, and controls the locking and unlocking means to lock all the door locks when driving operation is indicated.

A central locking system of this general type is shown in German Patent Application DE-AS No. 19 21 696, which can perform the following functions: central locking and unlocking of all the doors from the outside of the vehicle by a change-over switch when the lock cylinder is actuated by the vehicle key; a central locking and unlocking of all doors from the inside of the vehicle through a manually operable touch contact locking switch; and a central locking of all the doors by actuating a driving-operation locking switch when the handbrake is released. In addition, in this system, when the handbrake is pulled, the doors are unlocked by actuating an inside door securing button separately and manually. On the other hand, unlocking of the doors is prevented when an inside door actuating handle is actuated. These functions ensure that in addition to the normal key-operated central function, when the handbrake is released, the doors are locked automatically, so that no vehicle door can be opened during the drive. This also makes it necessary to pull the handbrake before the doors can be opened.

An objective of the present invention is to provide a central locking system so that in addition to the key-operated central function, when the vehicle is started, an automatic central locking takes place, while an entering and exiting of the vehicle remains possible during the running of the vehicle engine. After each entrance or exit of the vehicle, central locking will occur when the vehicle is running.

These and other objectives are attained by the present invention by providing a central locking system of the above described type with override means for overriding the control of the door locking means by the driving operation indicator, which in the preferred embodiment, indicates operation of the engine. Actuation of the override means causes the door locking means to unlock all the doors, even when the engine operation indicator indicates engine operation. Control of the door locking means is returned to the engine operation indicator when the actuation of the override means is ceased. A preferred embodiment provides plural override means to temporarily override the control of the door locking means by the engine operation indicator. In the preferred embodiment, one of the override means is actuated by a switch in the passenger compartment of the vehicle, while another override means is actuated by a door switch which is closed when an inside door handle of the vehicle opens one of the vehicle doors. This allows entry and exit of the vehicle through all the vehicle doors when the engine is running.

Further objects, features and advantages of the present invention will become more apparent from the following description when taken with the accompanying drawings, which show for purpose of illustration only, an embodiment constructed in accordance with the present invention.

BRIEF DESCRIPTION OF THE DRAWINGS

The sole drawing figure is a schematic representation of the preferred embodiment of a central locking system constructed in accordance with the present invention.

DETAILED DESCRIPTION OF THE DRAWINGS

A pneumatic regulating element 1 is installed in each door (not shown) of a motor vehicle. The pneumatic regulating element 1, via a supply line 2, is supplied by a bipressure pump 18 with positive pressure for unlocking and with a vacuum for locking of the door lock. An actuating rod 1' of the regulating element 1 moves during the pressure admission, in a conventional manner, to affect the mechanism of the door lock. In addition, there is an operative connection between the inside door actuating handle 3 and the actuating rod 1' as well as between the actuating rod 1' and the lock cylinder 4 which is located only on the front doors. A change-over switch 5 is integrated into the regulating element 1, and the switching contact 5' of the change-over switch 5 is also in operative connection with the actuating rod 1'. Thus, in the illustrated preferred embodiment, each door has an inside door handle 3, a pneumatic regulating element 1, and a change-over switch 5, while the lock cylinders 4 are provided only in the front doors.

A door contact switoh 6 is provided at each vehicle door, with a touch contact locking switch 7 and the ignition switch 8 for the driving operation located on the inside of the vehicle in the area of the driver's seat. Three relays 9, 10 and 11 are provided for the switching function and are installed, for example, in the proximity of the bipressure pump 18 in the vehicle.

Starting from a centrally locked condition, the method of operation of the central locking system is the following:

When the vehicle is to be unlocked and the lock cylinder 4 is actuated by the key, for example, at the driver's door, the actuating rod 1' of the regulating element 1 is shifted. The switching contact 5' is thereby switched from a negative to a positive pole in a conventional manner, not illustrated. From the pole contact of the change-over switch 5, this positive voltage potential, through the switching line 12, the relay contact 9' of the non-actuated relay 9 and the control line 13, is received by the bipressure pump 18. As a result, the pump 18 generates positive pressure and supplies this positive pressure via the pneumatic supply lines, to each regulating element 1 at the individual doors. The actuating rods 1' will then unlock the door locks so that the vehicle can be entered and the doors then locked.

By actuating the ignition switch 8, the vehicle is started, and the relay 9 is actuated by the now closed ignition switch 8 and the plus line 17. This prevents the change-over switch 5 from having an effect on the bipressure pump 18. The contact 9' of the relay 9 is switched over to the switching line 14 so that via the grounding line 16, the relay contact 11' of the non-actuated relay 11, the switching line 15, the relay contact 10' of the non-actuated relay 10, the switching line 14, the relay contact 9' and the control line 13, negative voltage is received by the bipressure pump 18. As a result, the pump 18 generates a vacuum and via the pneumatic supply lines 2, all regulating elements 1 at the individual doors are supplied with vacuum, so that the actuating rods 1' lock the door locks.

When the driver wants to admit other passengers when the engine is running, the central locking system can be unlocked via the tough contact locking switch 7. The ignition switch 8 is closed at this time. When the touch contact locking switch 7 is pressed into its locking position, a positive voltage potential, via the plus line 17, reaches the relay 11 which is thus actuated. The contact 11' of the relay 11 is switched so that via the plus line 17, the relay contact 11', the switching line 15, the relay contact 10' of the non-actuated relay 10, the switching line 14, the relay contact 9' and the control line 13, positive voltage potential is received by the bipressure pump 18 which then generates the positive pressure required for the central unlocking of the doors.

If the passengers have entered, the touch contact closing switch 7 is released and the relay 11 becomes inactive again. Via the grounding line 16, the relay contact 11', the switching line 15, the relay contact 9' and the control line 13, negative voltage potential is again received by the bipressure pump 18 which generates the vacuum required for the locking operation. All door locks are therefore automatically centrally locked again.

If a passenger wants to leave the vehicle while the engine is running, (when the ignition switch 8 continues to be closed) he can open the door via the inside door actuating handle 3. When the door is opened, the pertaining door contact switch 6 is closed and the relay 10 is actuated, so that its relay contact 10' switches over to the plus line 17. Via the plus line 17, the relay contact 10', the switching line 14, the relay contact 9' and the control line 13, the positive voltage potential now reaches the bipressure pump 18, which as a result generates positive pressure and unlocks all door locks.

After the passenger has left the vehicle, and the door is closed, the door contact switch 6 is opened again and as a result, the relay 10 becomes inactive again. Via the grounding line 16, the relay contact 11' of the non-active relay 11, the switching line 15, the relay contact 10', the switching line 14, the relay contact 9' and the control line 13, negative voltage potential is received by the bipressure pump 18 so that by means of the generated vacuum, all door locks are again automatically centrally locked.

When, at the end of the drive, the ignition is switched off, the ignition switch 8 is opened and the relay 9 becomes inactive. This allows change-over switch 5 to effect control of the bipressure pump 18. This prevents automatically controlled central locking of the doors. The relay contact 9' now connects the control line 13 with the switching line 12 which, however, still carries negative voltage potential, because the vehicle is still centrally locked. However, when the driver's door or the front passenger's door is opened via the inside door actuating handle 3, the actuating rod 1' of the regulating element 1 is shifted again. The switching contact 5 of the change-over switch 5 is thereby switched from the negative to the positive pole, so that via the switching line 12, the relay contact 9' and the control line 13, positive voltage potential reaches the bipressure pump 18. This bipressure pump 18 generates positive pressure and brings all regulating elements and thus also all door locks into their unlocking position.

After the vehicle has been left and the doors are closed, the vehicle is locked by means of the key. The lock cylinder 4 is actuated by the key, and the actuating rod 1' of the regulating element 1 is shifted again. The switching contact 5' of the change-over switch 5 is now switched from the positive to the negative pole, so that via the switching line 12, the relay contact 9' and the control line 13, negative voltage potential reaches the bipressure pump 18, which generates a vacuum. Via the pneumatic supply lines 2, the pump 18 supplies each regulating element at the individual doors with vacuum, whereupon their actuating rods lock the door locks. The vehicle is now centrally locked.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. A central locking system for a motor vehicle with a multiple position operation for door locks that are actuable for either hydraulic or pneumatic regulating elements, said door locks locking a driver door, a front passenger door, and rear doors, said system comprising:

electric switching means for outputting a switching signal for a central power-actuated control of all said door locks into locking and unlocking positions;

lock cylinders actuable by a key at least at said driver door and said front passenger door, said lock cylinders being operably connected with said regulating element and said switching means to control said locking and unlocking of said door locks upon key actuation of one of said lock cylinders;

ingnition switch means, connected to said switching means, which in a closing position, causes said switching means to output a signal for locking all said door locks and in an open position permits unlocking of said door locks;

touch contact locking switch means in a passenger compartment and connected to said switching means for overriding said ignition switch means to unlock all said door locks when said touch contact locking switch means is closed, and returning control of said door locks to said ignition switch means when said touch contact locking switch means is opened;

door contact switch means which is closed when one of said doors is open, said doors being operable by actuation of an inside door actuating handle, said door contact switch means being connected to said switching means such that when one of said doors is open and said ignition switch means is in a closing position, said door contact switch means is closed and overrides control of said switching means by said ignition switch means so as to open all said door locks, and when said doors are closed, said door contact switch means is open such that control of said switching means is returned to said ignition switch means and said door locks are locked; and change-over switch means connected to said switching means for causing said switching means to output unlocking signals when said ignition switch means is in an open position and at least one of said driver door and said front passenger door is opened via said inside door actuating handle.

2. A central locking system according to claim 1, further comprising:

a bi-pressure pump;

a control line connected to said pump for controlling said pump;

first, second and third relays connected to said control line and having actuated and non-actuated states;

wherein unlocking of said lock cylinders by said swtiching means causes said control line and said first relay which is in a non-actuated state, to feed positive potential to said pump for causing said pump to generate excess pressure;

wherein actuation of said ignition switch means into said closing position causes negative potential to be fed to said pump via said first relay which is in said actuated state, said second and third relays which are in said non-actuated states, and via said control line, thereby causing said pump to generate vacuum and centrally lock all said door locks by means of said regulating element;

wherein actuation of said touch contact locking switch means into its closed position causes said third relay to be actuated, thereby causing positive potential to be fed to said pump via said second relay which is in said non-actuated state, said first relay which is in said actuated state, and said control line;

wherein release of said touch contact locking switch means into its open position, causes negative potential to be fed to said pump via said first relay which is in said actuated state, and said second and third relays which are in said non-actuated states, and said control line;

wherein opening of one of said locked doors via said inside door actuating handle causes said door contact switch means to be closed and said second relay to be actuated thereby causing positive potential to be fed to said pump via said first relay which is in said actuated state, and said control line;

wherein said closing of said door causes said door contact switch means to open, and said negative potential to be fed to said pump via said first relay which is in said actuated state, and said second and third relays which are in said non-actuated states;

wherein said first relay is in said non-actuated state after said ignition switch means is actuated into said opening position, and at least one of said driver and said front passenger doors is opened via said inside door actuating handle, said change-over switch means causing positive potential to be fed to said pump via said first relay and said control line; and wherein negative potential is fed to said pump via said first relay which is in said non-actuated state and said control line when said lock cylinder is actuated by said change-over switch means at said regulating element.

* * * * *